US008136368B2

(12) United States Patent
Reich et al.

(10) Patent No.: US 8,136,368 B2
(45) Date of Patent: Mar. 20, 2012

(54) MODULAR EVAPORATOR AND THERMAL ENERGY STORAGE SYSTEM FOR CHILLERS

(76) Inventors: Daniel Reich, Tucson, AZ (US); Michael Paul Burdett, Tucson, AZ (US); Vladimir D. Reich, Tucson, AZ (US)

( * ) Notice: Subject to any disclaimer, the term of this patent is extended or adjusted under 35 U.S.C. 154(b) by 0 days.

(21) Appl. No.: 13/038,014

(22) Filed: Mar. 1, 2011

(65) Prior Publication Data

US 2011/0162400 A1 Jul. 7, 2011

Related U.S. Application Data

(60) Provisional application No. 61/365,443, filed on Jul. 19, 2010.

(51) Int. Cl.
*F25D 17/02* (2006.01)

(52) U.S. Cl. ..... 62/434; 62/59; 62/66; 62/150; 62/199; 62/200; 62/222; 62/224; 62/225; 62/340; 62/430; 62/435; 165/170; 165/171; 165/176

(58) Field of Classification Search ..... 62/59, 66, 62/150, 199, 200, 222, 224, 225, 340, 430, 62/434, 435; 165/170, 171, 176
See application file for complete search history.

(56) References Cited

U.S. PATENT DOCUMENTS

| | | | | |
|---|---|---|---|---|
| 2,538,016 | A * | 1/1951 | Kleist | 62/139 |
| 4,827,735 | A * | 5/1989 | Foley | 62/430 |
| 6,216,469 | B1 * | 4/2001 | Miller | 62/59 |
| 6,253,567 | B1 * | 7/2001 | Imanari et al. | 62/434 |
| 7,363,772 | B2 * | 4/2008 | Narayanamurthy | 62/333 |
| 7,503,185 | B2 * | 3/2009 | Narayanamurthy et al. | 62/332 |
| 7,905,110 | B2 * | 3/2011 | Reich et al. | 62/434 |
| 2008/0034760 | A1 * | 2/2008 | Narayanamurthy et al. | 62/59 |

* cited by examiner

*Primary Examiner* — Frantz Jules
*Assistant Examiner* — Azim Rahim
(74) *Attorney, Agent, or Firm* — Morgan Law Offices, PLC

(57) ABSTRACT

A modular evaporator which can be assembled from a number of standard modules is provided. Depending on the requirements, the modular evaporator can be assembled to meet a wide range of design cooling loads. Additionally, the modular evaporator is capable of generating and holding ice for thermal storage purposes, eliminating the need for external ice storage tanks. Furthermore, the heat transfer and thermal storage fluid for the evaporator can simply be water which considerably simplifies the system, lowers the cost, and increases the efficiency of the heat transfer loop.

19 Claims, 13 Drawing Sheets

FIG. 5 *(View A-A of Fig. 4)*

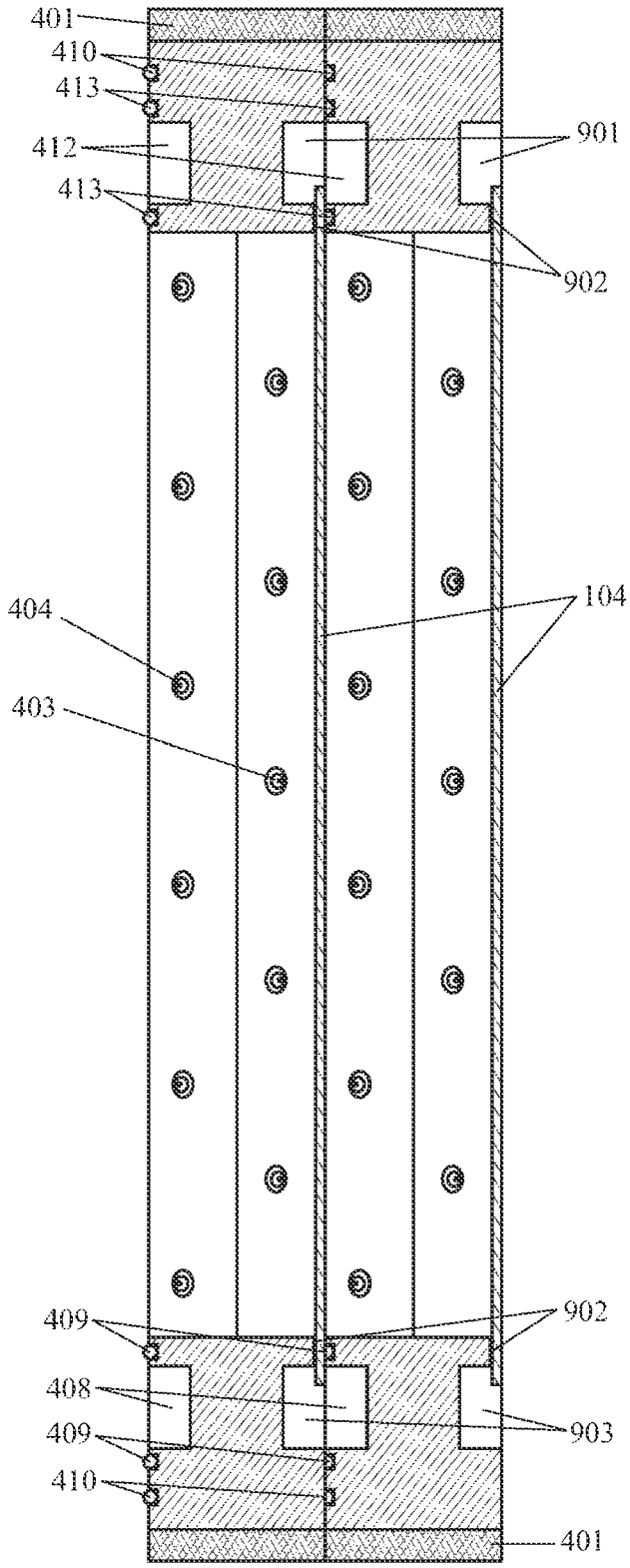
FIG. 9 *(View B-B of Fig. 4)*

MODULAR EVAPORATOR AND THERMAL ENERGY STORAGE SYSTEM FOR CHILLERS

CROSS-REFERENCE TO RELATED APPLICATIONS

The present application is related to and claims priority from prior provisional application Ser. No. 61/365,443, filed Jul. 19, 2010, entitled Modular Evaporator and Thermal Energy Storage for Chillers, the contents of which are incorporated herein by reference.

FIELD OF THE INVENTION

The present invention relates to cold thermal energy storage systems as well as using such systems to optimize and reduce energy consumption of a building. In particular, this invention relates to a novel modular evaporator and thermal energy storage system for chillers.

BACKGROUND

Improving the energy efficiency of building comfort systems has become increasingly more important due to rising energy costs, as well as increased awareness and concern over global warming as a result of humanity's rising consumption of carbon fuels for electrical energy generation, direct burn heating, and domestic hot water appliances. One area where these concerns can be addressed is through improving the efficiency of solar-based HVAC systems by generating ice during hours of sunshine for later use during the night or cloud cover when solar radiation is inadequate. In traditional HVAC system this can also be beneficial through leveling demand by shifting some of the load during peak hours of a day to off-peak times, thereby eliminating the need to build and run expensive and inefficient peak generator turbines (peakers).

Demand control and increased efficiency is primarily accomplished by shifting the burden of cooling from the hottest time of the day to the nighttime when ambient temperatures, as well as demand, are considerably lower. Refrigeration equipment efficiency increases when the temperature lift requirement decreases. The difference in temperature lift between a hot day and a cool night can often be as high as 50%, thereby resulting in a massive drop in refrigeration equipment lift requirements and a corresponding efficiency increase. The demand for cooling is usually highest during peak hours when outside temperatures and solar radiation are at their highest levels which results in increased electrical consumption. In order to prevent strain on the power grid, utilities are often forced to use gas turbine peak generators for only a few of the hottest hours of the year. The efficiency of these generators is typically 40 to 50% lower than steam turbines which generate most of our electricity. An alternative to peak generation is Thermal Energy Storage (TES) technology.

While there are different types of thermal storage systems on the market the most common designs are based on cold water or two-phase ice/water storage. In recent years the ice storage systems have increased in popularity due to a considerably higher energy storage density. Currently ice storage systems are commonly used in large buildings and campuses. These systems will generally contain chillers which cool a secondary heat transfer media (such as an ethylene-glycol solution) to below the freezing point of water and circulate it through the heat exchangers of ice storage tanks.

Ice storage tanks are usually comprised of rectangular or cylindrical water-filled vessels containing heat exchangers. The heat exchangers are primarily made of circular copper or plastic tubing. The cooling solution flows through the heat exchanger thereby freezing the water. Examples of such systems are disclosed in U.S. Pat. No. 4,831,831 to Carter et al. and U.S. Pat. No. 6,247,522 to Kaplan et al.

These types of systems have several shortcomings. First they occupy a considerable amount of floor space for the chiller and the ice storage tanks Secondly, the solutions used as the heat transfer media are generally expensive, toxic, and have inferior heat transfer properties to water which increases the required pumping energy. And finally, the ratio of ice volume to the full volume of the storage tank is not very high due to the heat exchanger coil occupying a considerable amount of the tank's volume.

The process of calculating the growth of freezing water around multiple tubes is complicated and costly thereby making it impractical for commercial markets. The heat exchanger design is usually accomplished through an experimental approach which is expensive, time consuming and rarely produces satisfactory results. Pockets of water can be encapsulated by ice, then, when these pockets freeze, expansion can generate very high pressures which can damage the tubes and/or the shell. This problem is generally solved by restricting the entire tank water volume from freezing solid which in turn further reduces the average ice storage density and increases the size and weight of the tank required for meeting the cooling demand.

Another example of an approach used for ice-based thermal energy storage systems is disclosed in U.S. Pat. No. 7,124,594 to McRell. The thermal energy storage apparatus is comprised of a tank filled with water and a heat exchanger consisting of a multitude of spiral copper tubing coils connected to upper and lower headers. During the ice generating mode these coils are filled with liquid refrigerant provided by a condensing unit which evaporates and freezes the surrounding water. During cooling mode the liquid refrigerant is pumped into cooling coils inside the air conditioning equipment where it evaporates and is fed into the ice storage tank coils, surrounded by a slurry of ice and water, and is cooled and condensed back into liquid.

These systems are complicated and expensive. Also the density of ice storage is relatively low due to the fact that some of the water must remain unfrozen to ensure proper water circulation at the beginning of the cooling mode and to prevent coil damage due to the high pressures generated by the expansion of freezing ice.

U.S. Pat. No. 6,079,481 to Lowenstein et al. discloses a thermal energy storage system where the heat exchanger assembly is made of substantially flat profile boards disposed in a rectangular tank filled with water. A cooling medium with a low freezing temperature flows from a chiller through the boards and freezes the water, and then this solution flows through the load and back through the boards thawing the ice. While this design is potentially capable of increasing thermal energy storage density, it still requires separate spaces for the chiller and the thermal storage unit and requires a heat transfer medium with a freezing temperature below that of water.

Medium capacity chillers usually have direct expansion, tubes-in-shell evaporators. The refrigerant flows through the tubes and the water (or another heat transfer medium) circulates through the shell. Refrigerant is injected in the tubes and evaporates to cool the water. Each evaporator is designed for a specific load, so a chiller manufacturer must carry multiple models of evaporators with a wide range of capacities. Another shortcoming of tubes-in-shell evaporators is the necessity to prevent the heat transfer fluid from freezing on the tubes which would lead to reduction of their heat transfer properties and even their damage.

SUMMARY OF THE INVENTION

According to preferred embodiments of the present invention, a modular evaporator which can be assembled from a number of standard modules is provided. Depending on the requirements, the modular evaporator can be assembled to meet a wide range of design cooling loads. Additionally, the modular evaporator is capable of generating and holding ice for thermal storage purposes, eliminating the need for external ice storage tanks. Furthermore, the heat transfer and thermal storage fluid for the evaporator can simply be water which considerably simplifies the system, lowers the cost, and increases the efficiency of the heat transfer loop.

According to a preferred embodiment the modular evaporator and thermal energy storage apparatus comprises of a number of rectangular modules and two end plates. Cold plates are located between adjacent modules. Modules contain manifolds for distribution of water and refrigerant. All modules and end plates are compressed together forming a water tight vessel that is filled with water. Liquid refrigerant is distributed through the refrigerant manifolds and headers and is injected into the cold plates where it evaporates thereby cooling the cold plates and is then removed from the suction headers and manifolds by the chiller compressor. Water can be pumped into the modular evaporator through water supply manifolds and headers to jet-generating nozzles. In cooling mode, the jets thaw the ice and/or transfer heat to the cold plates.

Advantages of certain embodiments may include more compact thermal energy storage systems, simplification and reduction in the cost of production of chillers and thermal energy systems, and a considerable increase in the energy efficiency and comfort level of the conditioned environment.

Other advantages will be readily apparent to one skilled in the art from the following figures, descriptions, and claims. Moreover, while specific advantages were enumerated above, various embodiments can include some additional advantages while others may be absent.

BRIEF DESCRIPTION OF THE DRAWINGS

FIG. 9 is a vertical cross section view of the module (with a second module attached);

DETAILED DESCRIPTION

Figure 1:
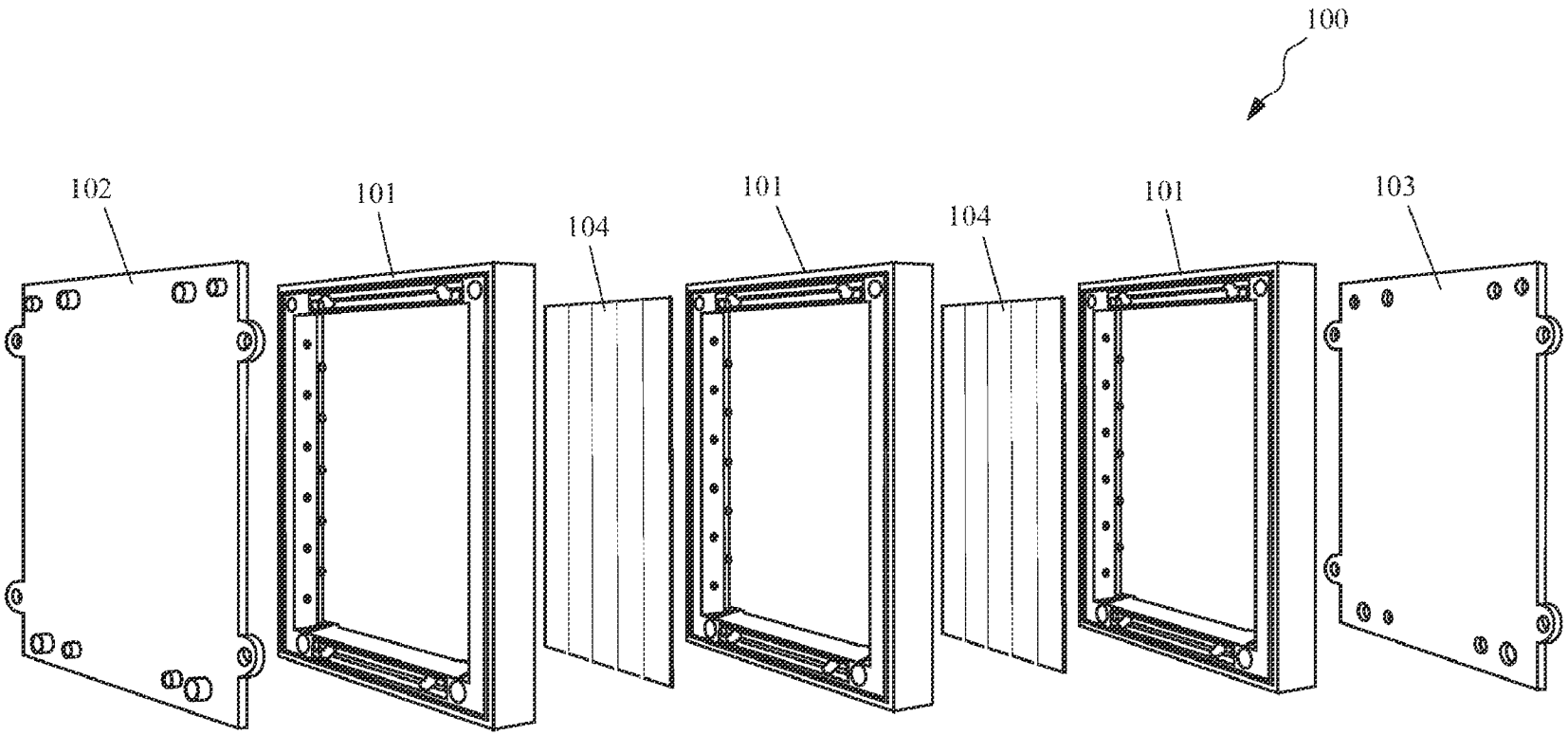
FIG. 1 is a simplified exploded view of a modular evaporator and thermal energy storage apparatus, according to a preferred embodiment of the present invention.

A preferred embodiment of a modular evaporator 100 incorporating the principles of the present invention is depicted in FIG. 1. As shown, and as will be described in greater detail, the modular evaporator 100 comprises several modules 101 held between respective end plates 102, 103. As depicted, direct expansion cold plates 104 are located between adjacent modules 101 in such a way that they are capable of being compressed by the modules 101. The cold plates 104 are sealed by gaskets.

Figure 2:
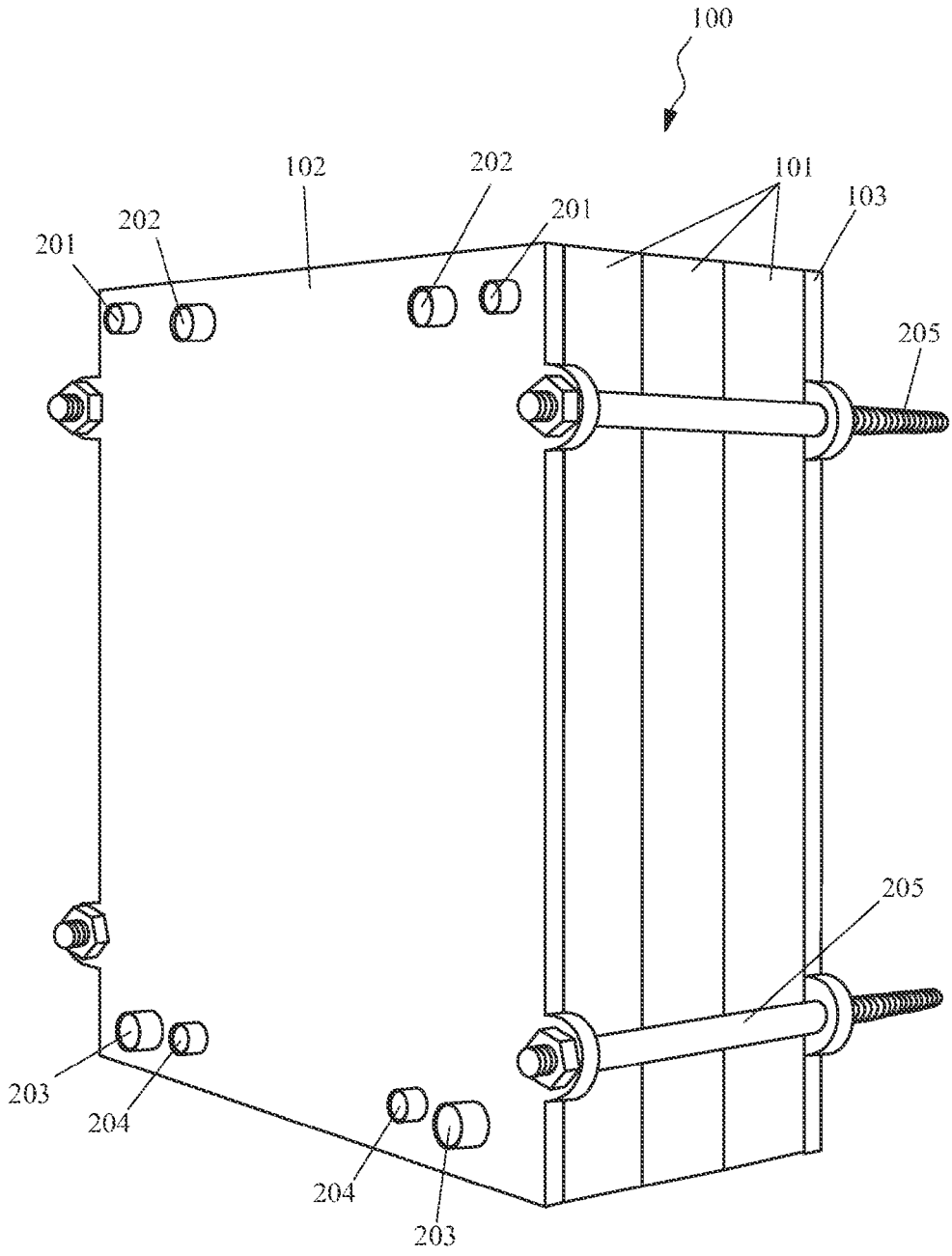
FIG. 2 is a view of the assembled modular evaporator and thermal energy storage apparatus.
Figure 3:
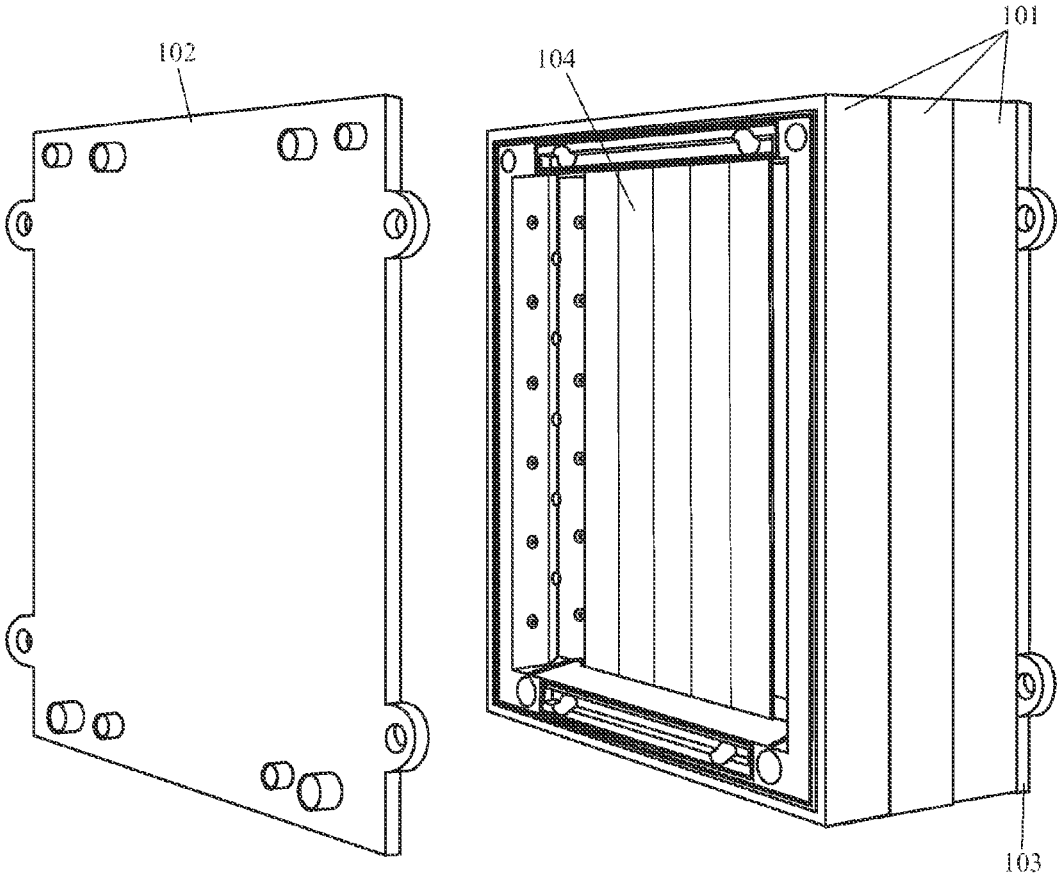
FIG. 3 is a view of the assembled modular evaporator and thermal energy storage apparatus with a separated end plate.

An assembled modular evaporator 100 is depicted in FIG. 2. The modules 101 and end plates 102, 103 are compressed and fastened together, preferably, by rods 205, forming a water tight vessel. The assembled modular evaporator 100 includes water supply sockets 201 and water return sockets 203, liquid refrigerant sockets 204, and suction sockets 202. FIG. 3 shows the modular evaporator with the end plate 102 detached.

Figure 4:
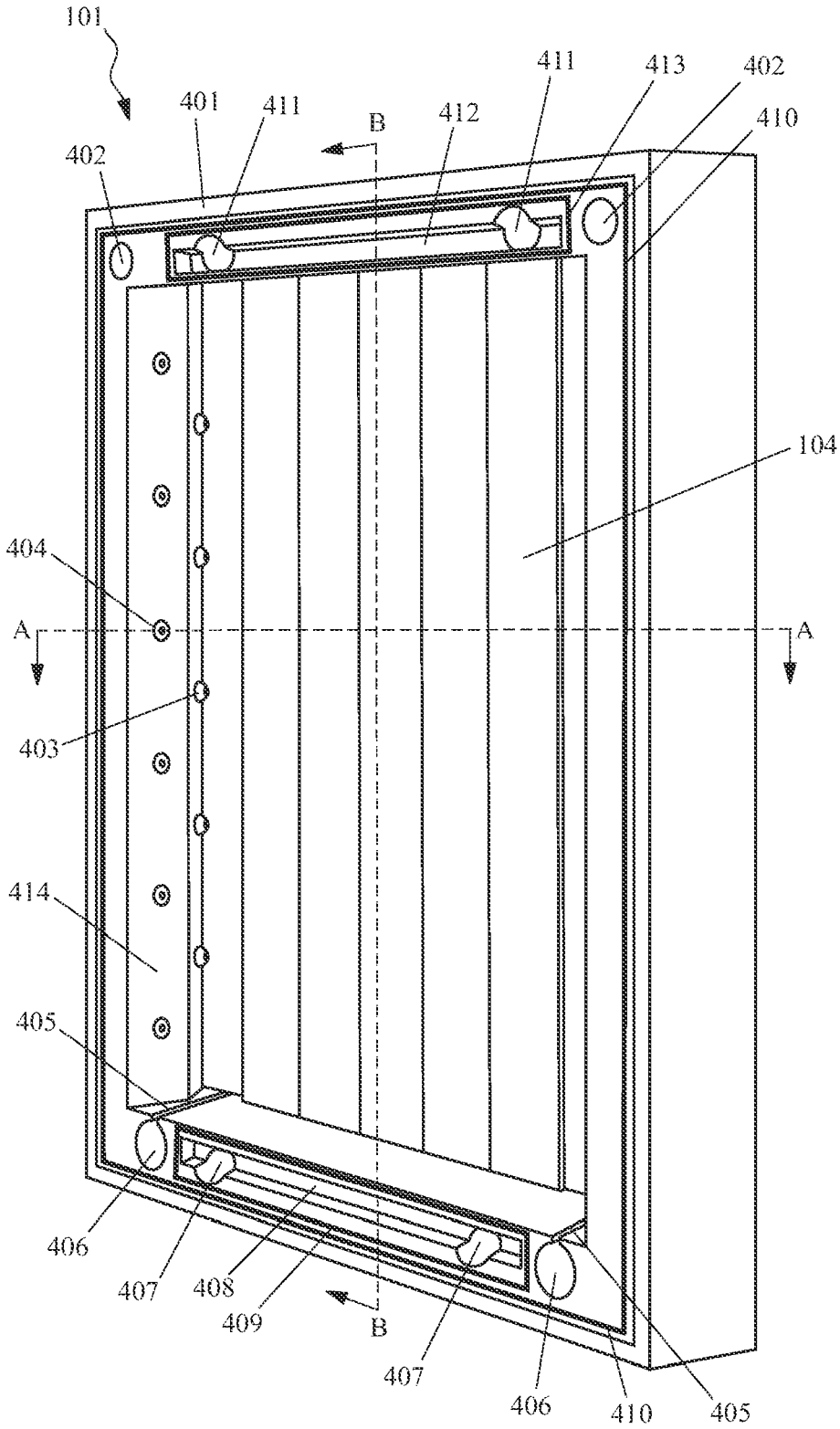
FIG. 4 is a view of a single module and cold plate of the modular evaporator and thermal energy storage apparatus.
Figure 5:
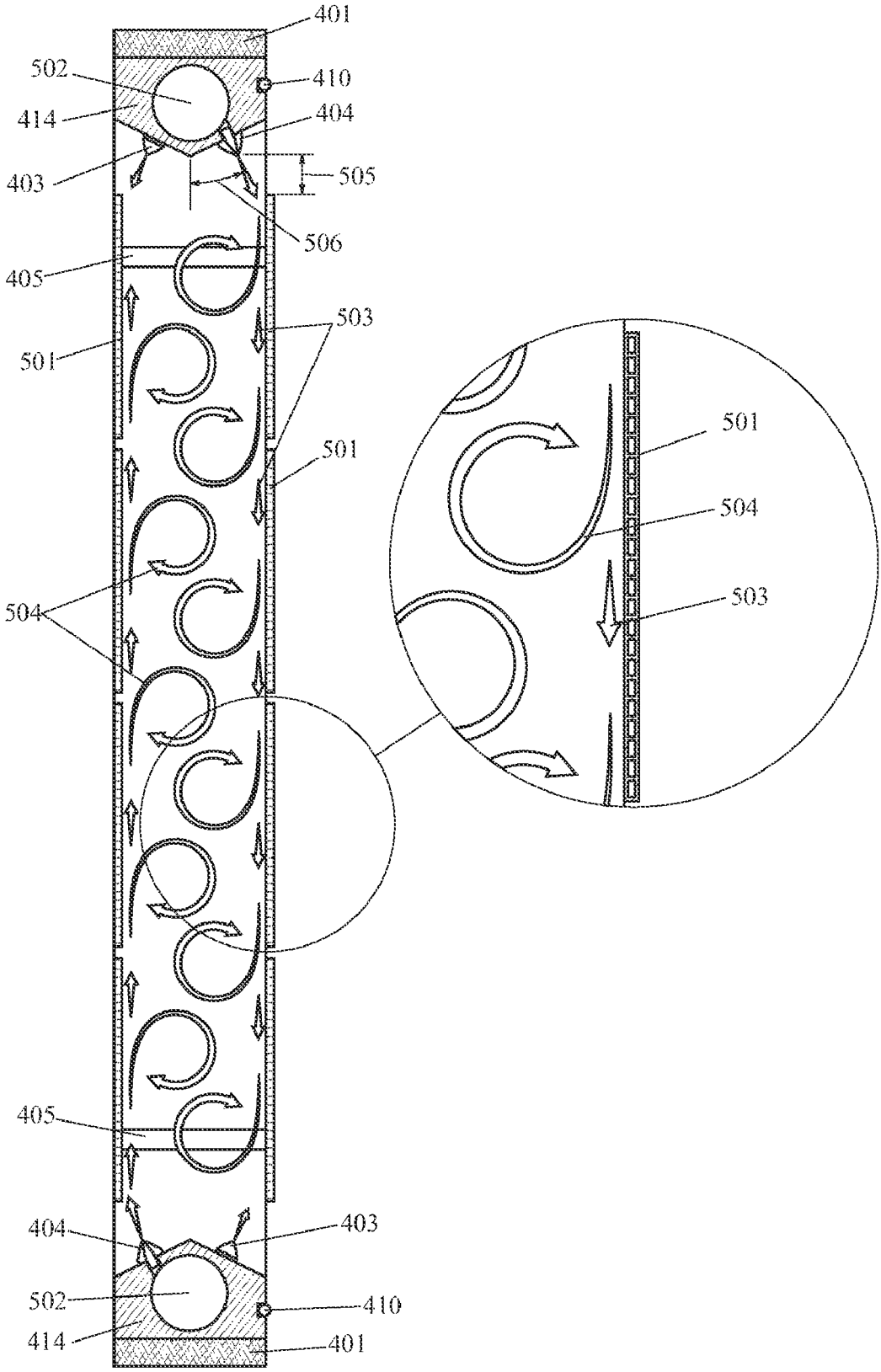
FIG. 5 is a horizontal cross section view of the module showing the water turbulence generated by the jets from staggered nozzles.

FIG. 4 depicts a single module 101 in more detail. It is to be understood that the sockets 201, 202, 203, and 204 are extensions of the manifolds formed by holes 402, 411, 406, and 407 in the module 101, respectively. The horizontal cross section A-A of the module 101 with an additional cold plate associated with adjacent module is represented by FIG. 5. The vertical headers 502 are connected to the supply manifolds 402. Dual sets of nozzles 403 and 404 are located on the vertical bars of the module frame 414 with angles 506, preferably opposite from one another respective to the horizontal axis of the vertical plane of the module such that the nozzles are in fluidic communication with the headers 502. Vertical slots 405 are connected to the horizontal water return manifolds 406 and function as the drains of the modular evaporator (slots or holes may be used for this purpose). The cold plates 104 can be formed of flat multiport aluminum extrusions 501 assembled side by side, as shown. The width of the cold plates 104 is selected to provide the distance 505 between the ends of the nozzles 403, 404 and the vertical edges of the cold plates 104 approximately equal to the half of the distance between two adjacent cold plates 104. The rate of ice grow in the ice generating mode in the horizontal direction parallel to the plate is considerably slower than in the perpendicular direction. The selection of the distance 505 assures that ice doesn't reach the nozzles, and that water in the area adjacent to the nozzles never freezes when the water in the spaces between the adjacent cold plates is frozen solid and the process of the ice formation is stopped.

A method of determining this event is provided in U.S. Pat. No. 7,832,217 to Reich, which is herein incorporated by reference in its entirety.

It is to be understood that gasket 410 prevents water leakage from the modular evaporator when all the modules are compressed together by the rods 205. Preferably, the periphery of each module 101 is covered with thermal insulation 401.

The vertical cross section B-B of the two modules 101 side-by-side is depicted in FIG. 9. Voids 408 and 903 on the bottom of the module and 412 and 901 on the top of the module form liquid refrigerant headers and suction headers when adjacent modules are compressed together. The gaskets 409 and 413 prevent the refrigerant from escaping the hermetic refrigerant system. The headers are connected with liquid refrigerant manifolds 407 and suction manifolds 411. Although two liquid and two suction manifolds are depicted in the figures, it should be understood that the design may be implemented with any number of manifolds. The cold plate 104 protrudes into the headers to prevent accidental obstruction of the fine ports of the extrusions 501 by debris. The cold plate 104 is bonded to the frame of the module by bonding compound 902 both on liquid and suction sides. Alternatively, refrigerant leak prevention can be accomplished by completely surrounding the cold plates by gaskets on both the liquid and suction header sides.

Figure 6:
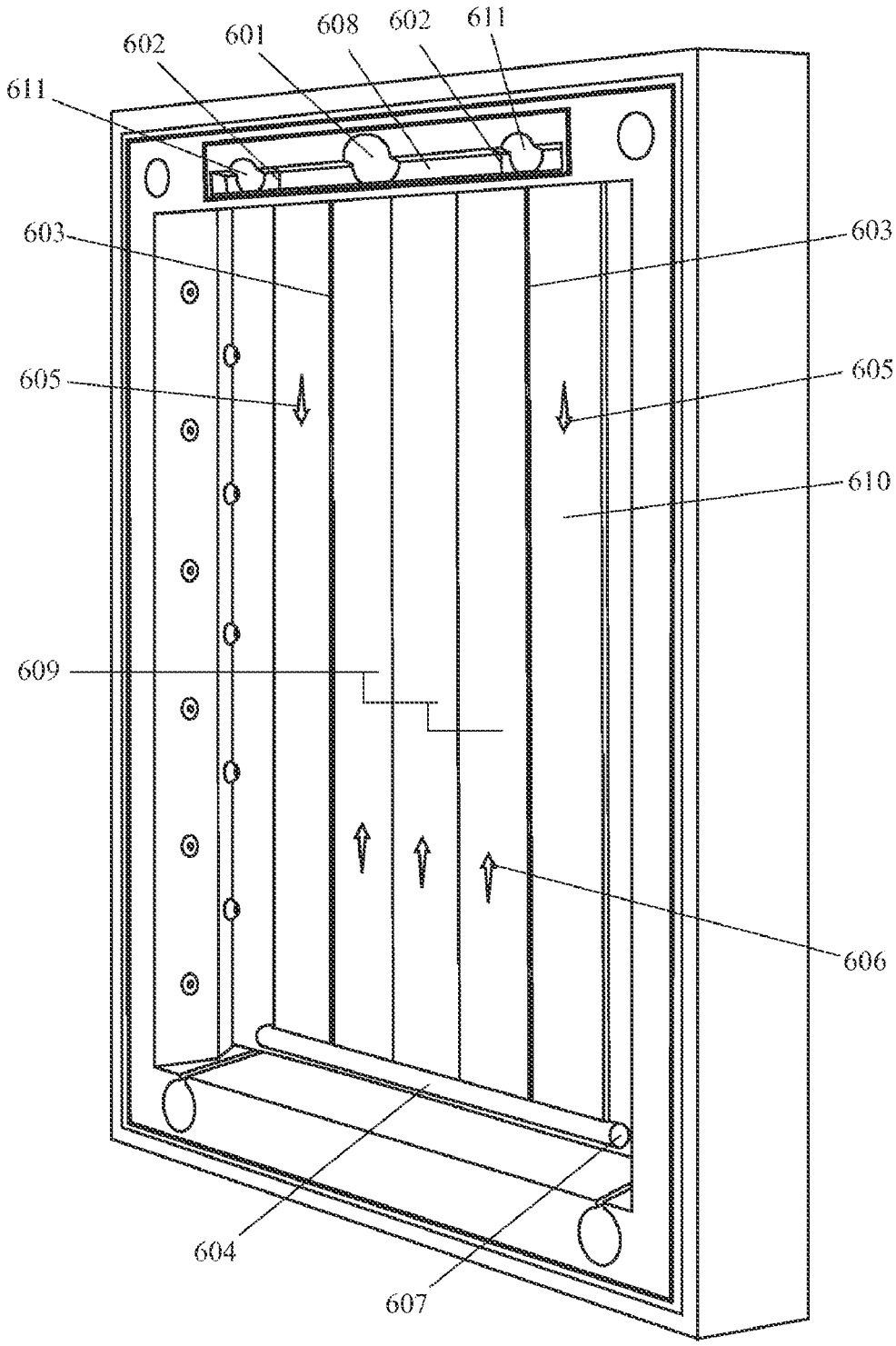
FIG. 6 is a view of a single module and cold plate of a modular evaporator and thermal energy storage apparatus, according to an alternate preferred embodiment of the present invention.

An alternative preferred design of the module 101 is depicted in FIG. 6. This design has both liquid and suction refrigerant manifolds on the top side of the frame of the module. The cold plate has a lower header made of a tube 604 with a slot running lengthwise across the tube. The tube has plugs 607 on both sides. The tube 604 is brazed to the bottoms of the multiport extrusions 609 and 610 and serves as the bottom distribution header. The top header 608 has two slots 602 to accommodate dividers which are installed in the process of assembly and divide the header in three parts. The sections located at the ends of the header are connected to the liquid manifolds 611 and serve as liquid refrigerant headers. The central section of the header is connected to the suction manifold 601 and serves as a suction header. The multiport extrusions 610 located on the sides of the cold plate have fluidic communication with the liquid refrigerant header. The direction of flow of the refrigerant in these extrusions is shown by the arrows 605. The central extrusions 609 are in fluidic communication with the suction part of the header 608. The direction of flow of the refrigerant in these extrusions is shown by the arrows 606. The gaps 603 between the adjacent extrusions connected to the liquid and suction parts of the header 608 are made wide enough to accommodate the dividers between the liquid and suction parts of the header 608.

The refrigerant when injected in the liquid sections of the header 608 flows through the ports of the extrusions 610 down to the bottom header 604 which provide fluidic communication among all the extrusions of the cold plate. Then the refrigerant flows through the ports of the extrusions 609 to the suction section of the header 608. It is possible to reverse the liquid and suction manifolds. The design can be also implemented with any numbers of liquid and suction headers (for example, one liquid and two suction).

Figure 7A:
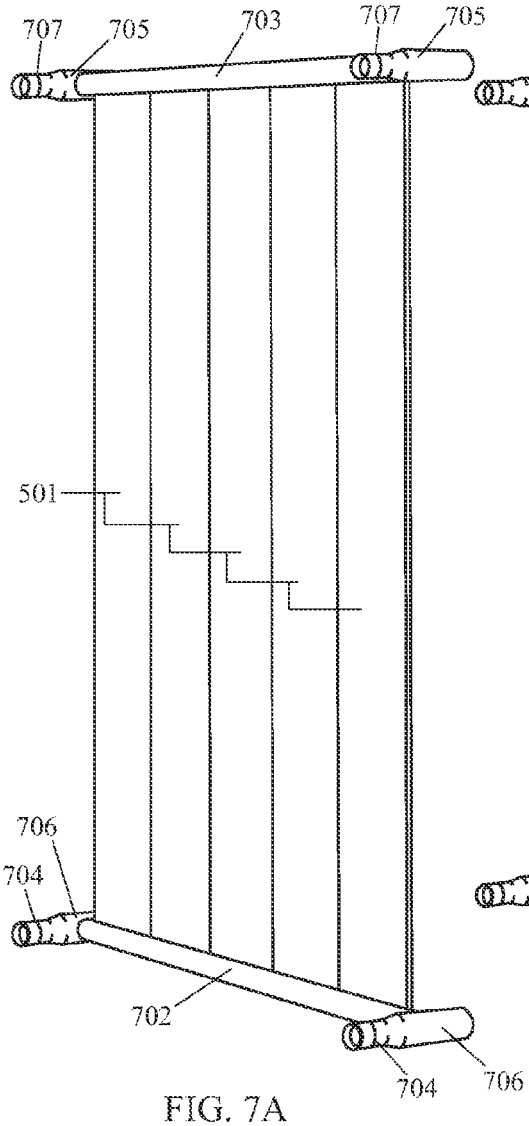
FIG. 7A is a view of a cold plate comprised of a number of brazed together micro multiport extrusions, headers, and manifolds.
Figure 7B:
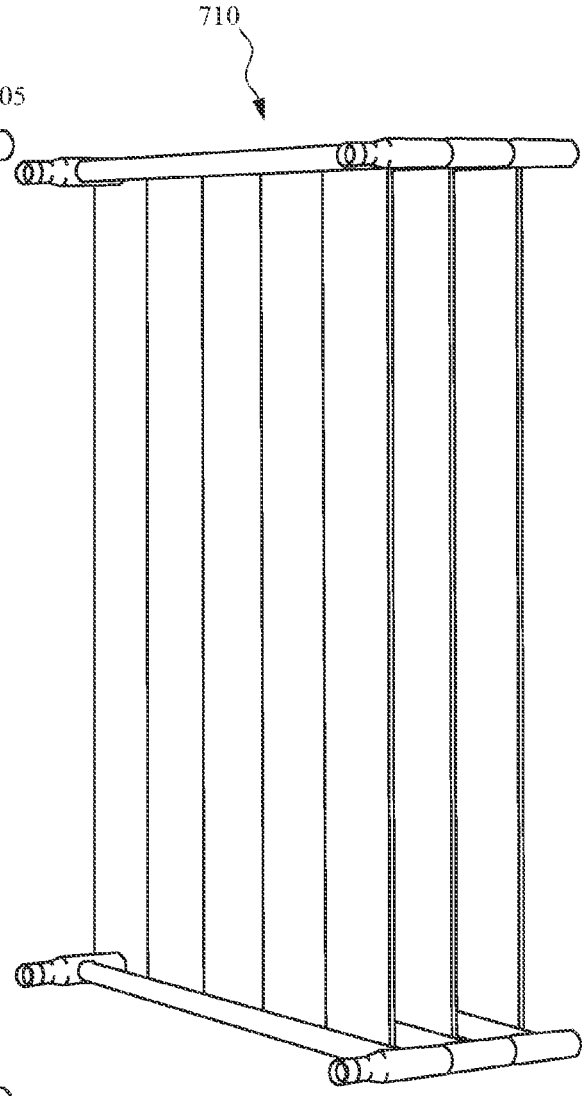
FIG. 7B is a view of a number of brazed cold plates assembled together with gaskets.

An alternative preferred design of the cold plates is shown in the FIG. 7A. In this case, the cold plate comprises a number of multiport extrusions 501, liquid header tube 702, suction header tube 703, liquid manifold sections 704, and suction manifold sections 705. Slots run along the length of the header tubes and the extrusions are inserted in these slots. The manifold sections 705 and 706 have both male and female connectors 704 and 707. The whole assembly is brazed together. When this cold plate is inserted inside the module frames 101 and modules are compressed together with gaskets at connectors 704 and 707 a refrigerant tight assembly is formed. This assembly 710 without frames is depicted in FIG. 7B.

Figure 8A:
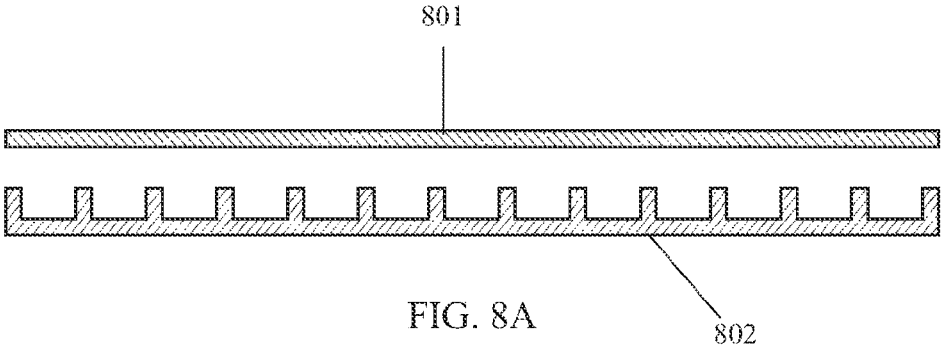
FIG. 8A is a cross section view of a cold plate comprising of a flat sheet of metal and a rolled profile before brazing or bonding.
Figure 8B:
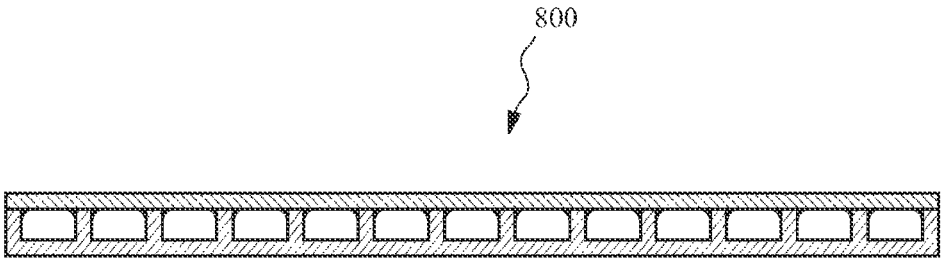
FIG. 8B is a cross section view of a brazed cold plate comprising of a flat sheet of metal and a rolled profile.

Another alternative preferred design of the cold plate is presented in FIG. 8A. The plate is comprised of two parts, a rolled sheet of metal with multiple channels 802, and a flat sheet of metal 801. These two sheets 801, 802 are brazed together forming a multiport heat exchanger 800 depicted in FIG. 8B. In lieu of rolled channel, corrugated sheet metal can be bonded between two flat metal plates.

Figure 10:
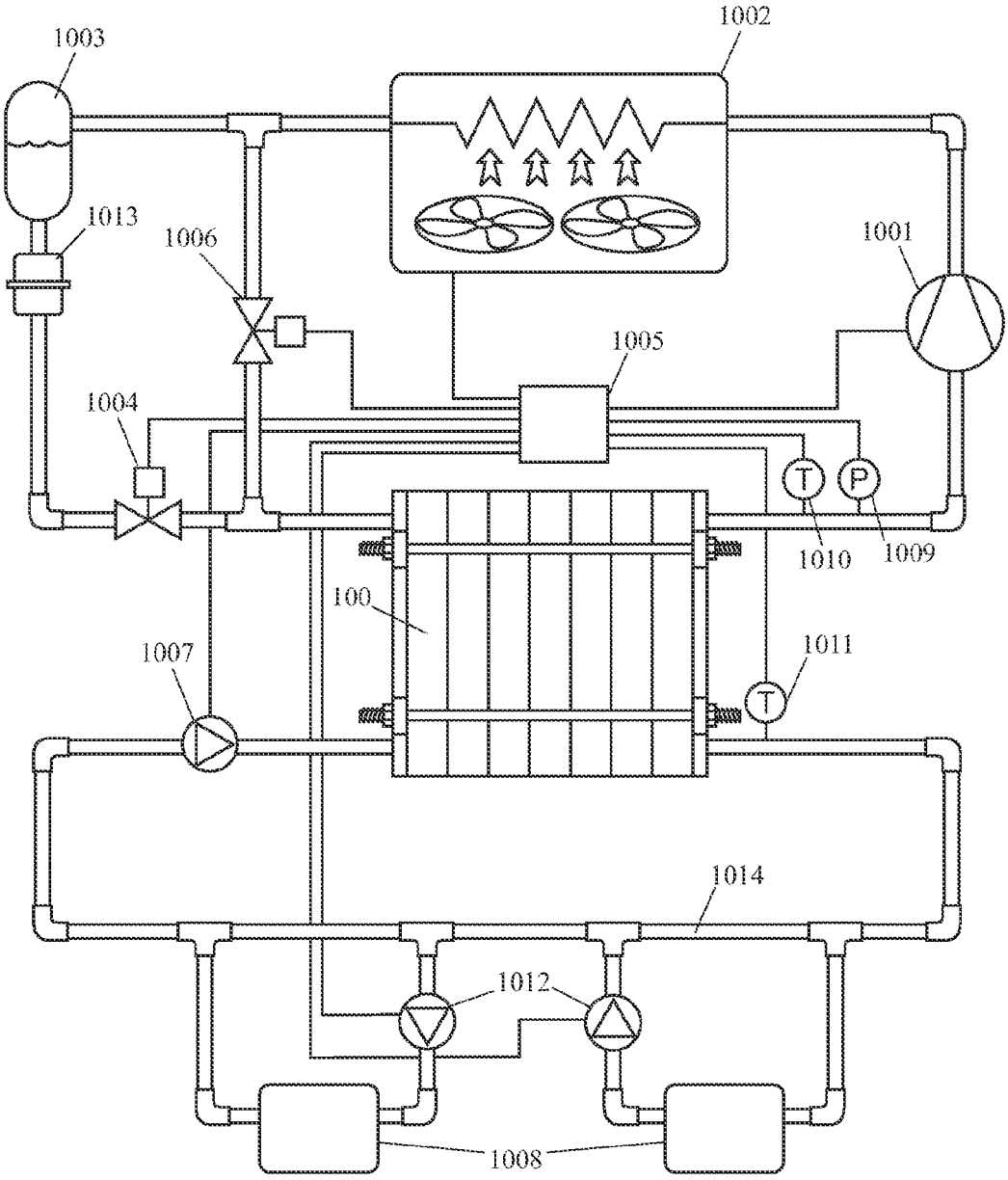
FIG. 10 is a block diagram of the chiller and thermal energy storage system containing a single modular evaporator, according to a preferred embodiment of the present invention.

The connection of the modular evaporator in the refrigerant and water loops is shown in FIG. 10. The compressor 1001 compresses the dry low pressure cool refrigerant coming through the suction line from the modular evaporator 100 converting it into hot high pressure gas. This gas enters the condenser 1002 and condenses there into liquid. Although an air cooled condenser is shown in FIG. 10 it can also be water cooled. The liquid refrigerant enters the receiver 1003 and accumulates there. The liquid refrigerant goes from the receiver 1003 through the filter-drier 1013 to the expansion valve 1004 which rations the liquid into the modular evaporator 100 and reduces its pressure partly flashing it into gas. The low pressure liquid and gas mixture flows through the liquid manifolds 407, the liquid headers formed by voids 408 and 903 and into the ports of the cold plates 104. There the liquid refrigerant evaporates cooling the cold plates. The controller 1005 receives signals from the pressure sensor 1009 and temperature sensor 1010 in the suction line, calculates the superheat, and modulates the expansion valve 1004 to maintain the superheat at the set point. This control strategy assures that the maximum volume in the internal space of the cold plates has liquid refrigerant present, and at the same time, only a negligible quantity of liquid refrigerant leaves the cold plates. An almost dry, low pressure refrigerant vapor travels from the cold plates to the suction header formed by voids 412 and 901 of adjacent plates, through suction manifolds 411 and back to the suction line of the compressor 1001.

The water loop of the system can be arranged in several configurations. In a preferred embodiment, it comprises of a main circulating pump 1007 which circulates water through the modular evaporator 100 and the main loop 114. Local pumps 1012 circulate water through loads 1008.

The system of FIG. 10 can function in the following distinctive modes: chiller mode, ice generation mode, ice harvesting mode, and hybrid mode.

In the chiller mode the compressor 1001 and water pumps 1007 and 1012 are on. The refrigerant's suction pressure is kept at a point corresponding to a temperature above the freezing point of water by modulating the expansion valve. The water pump 1007 injects warm water from the loads 1008 into the evaporator 100, flows through the manifolds 402, vertical headers 502 and into the nozzles 403 and 404. The nozzles generate water jets directed at the surfaces of the cold plates which facilitate the heat transfer from the water to the cold plates causing the liquid refrigerant to evaporate. The cooled water leaves the modular evaporator through drain slots 405 and return manifolds 406 and is injected in the main water loop 1014. The pumps 1012 extract the required quantity of cold water from the main loop 1014 to feed the loads 1008. The warm water from the load is injected back into the main loop 1014.

The water supply temperature 1011 is measured by the controller 1005. When the supply water temperature 1011 drops to the set point (which is above the freezing temperature of water) the controller 1005 turns the compressor off. When the supply water temperature rises to the set point plus a dead band the compressor is turned back on. A large volume of water in the modular evaporator minimizes cycling of the compressor. The other way of controlling the supply water temperature is by modulating the output capacity of the compressor.

The preferred embodiment of the module depicted in FIG. 6 has two columns of nozzles 403 and 404 on each vertical bar of the module frame. The nozzles on each column are staggered both adjacently and on the opposing sides of the frame. This staggering facilitates intensive turbulence in the water space between the two adjacent cold plates 104. The turbulence is illustrated in FIG. 5 by arrows 503 and 504. This turbulence in turn facilitates an increase in the rate of heat transfer between the water and the cold plates. The angle 506 between the nozzle axis and the module plane is selected to maximize the jet flow on the surface of the cold plate and, at the same time, minimizing leakage of the jet water into the adjacent space.

Figure 11:
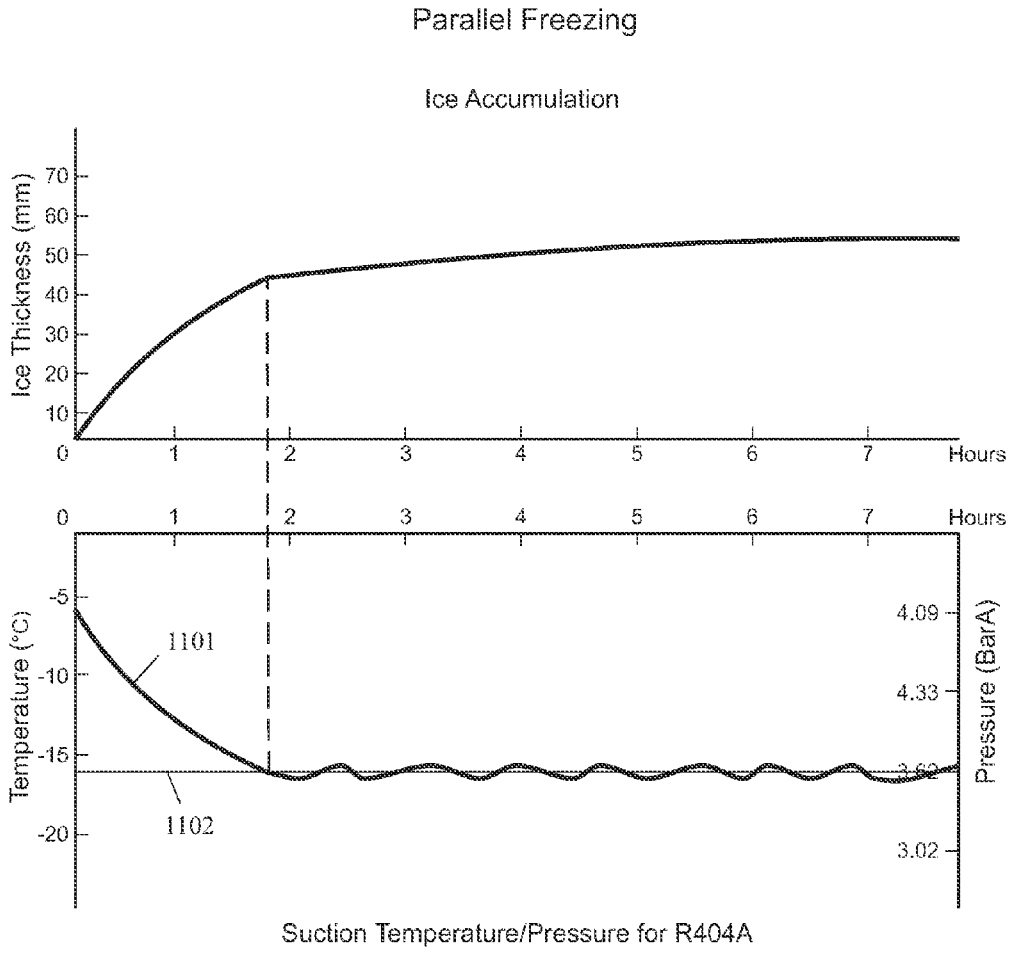
FIG. 11 is a graph illustrating the process of ice growth in a system of FIG. 10.

In ice generating mode the compressor 1001 is on and the pumps 1007 and 1012 are off. The ice grows on both sides of the cold plates 104. Ice is a relatively good thermal insulator by comparison with water in the presence of convection. Therefore the heat transfer rate from the freezing water to the refrigerant drops during the process of ice growth. As a result of this process the suction pressure also drops as shown in graph 1101 on FIG. 11. When the pressure drops to the set point 1102, the controller 1005 starts opening the hot gas bypass valve 1006 thereby injecting hot gas into the modular evaporator 100 and maintaining the suction pressure at a constant set point. Alternatively, instead of using this hot gas bypass technique, compressor capacity modulation can be used.

Figure 12:
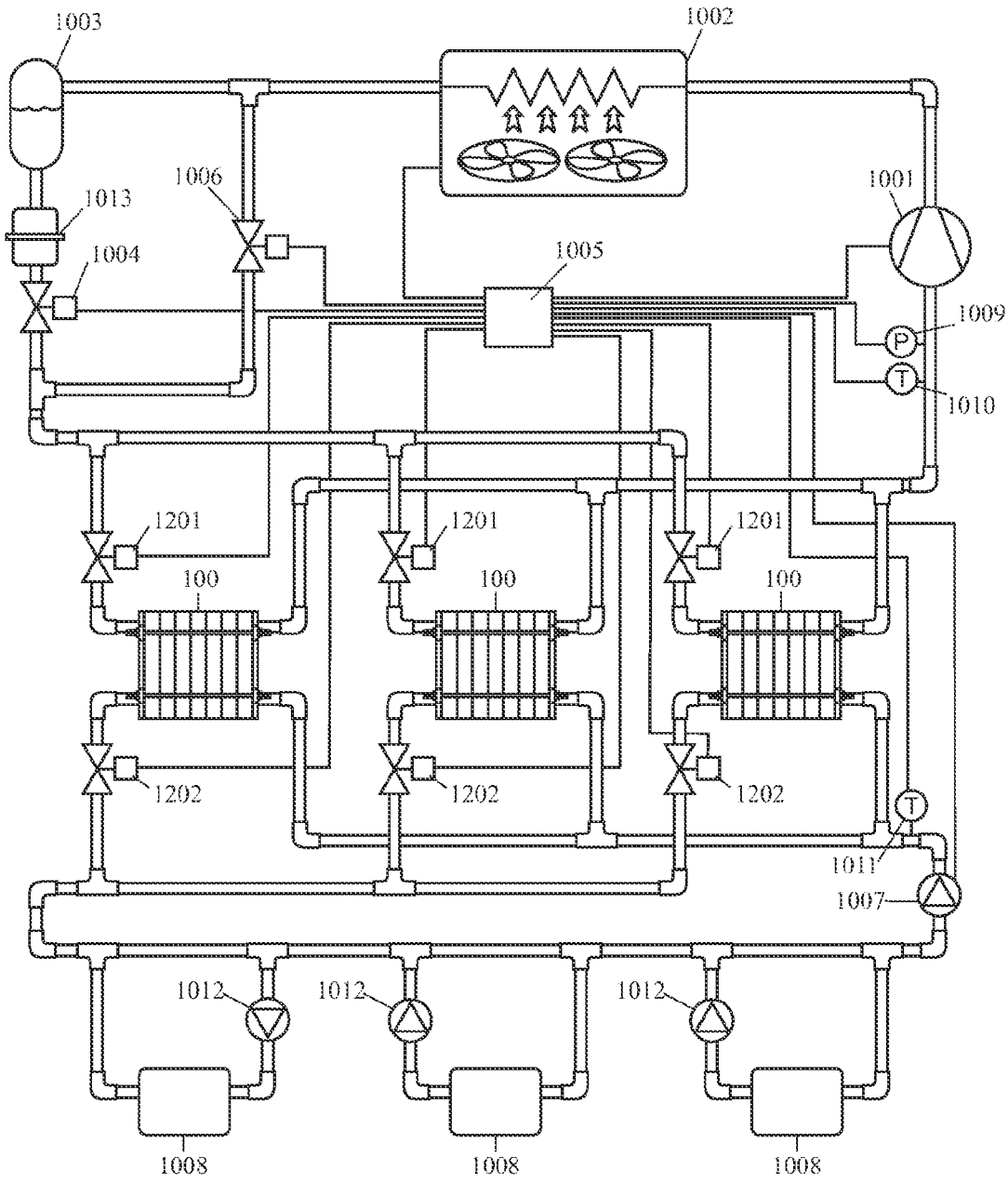
FIG. 12 is a block diagram of the chiller and thermal energy storage system containing multiple modular evaporators.
Figure 13:
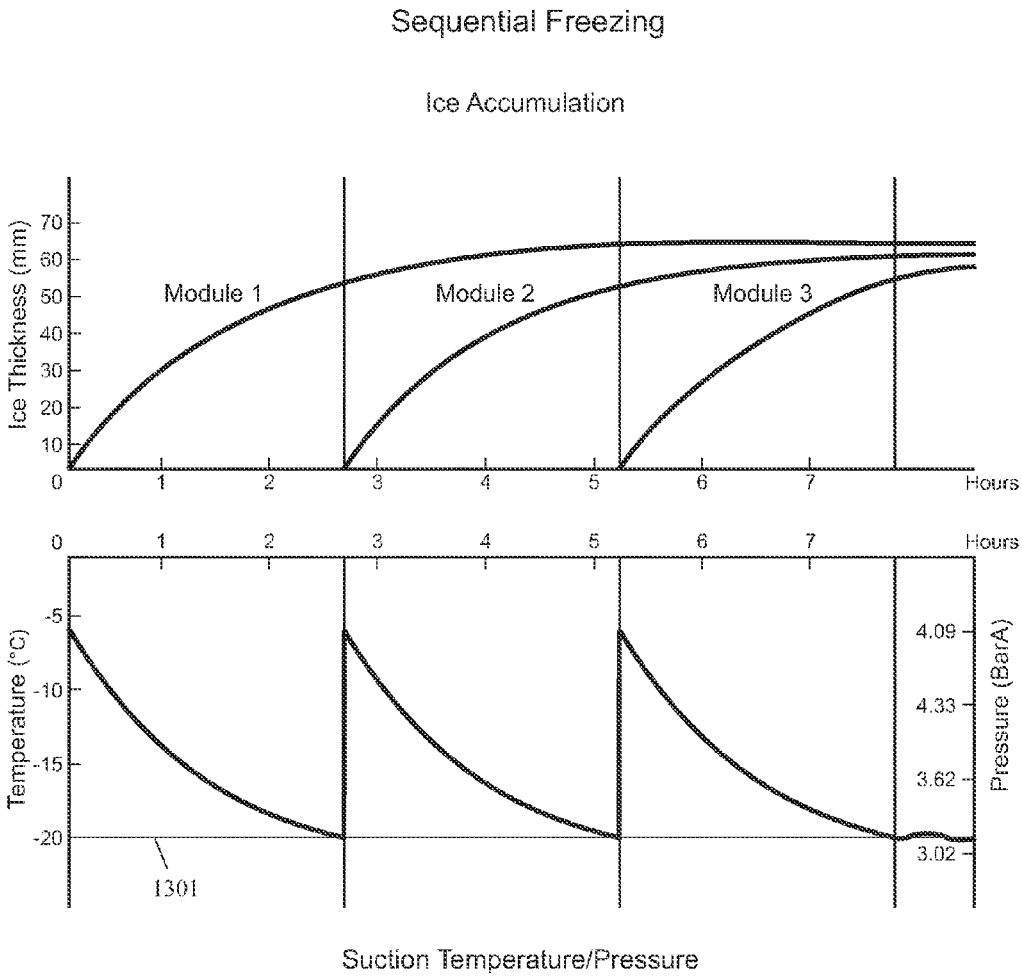
FIG. 13 is a graph illustrating the process of ice growth in a system of FIG. 12.

Another way of controlling the suction pressure is having multiple modular evaporators connected in parallel as shown in FIG. 12. Each evaporator has its own modulating expansion valve with shutdown capability 1201. The graph of the process of ice growth is shown in FIG. 13. The process starts with ice growth in the first evaporator. When suction pressure reaches the set point 1301 the second evaporator is turned on, and so on. The process continues until the last evaporator is turned on by opening the corresponding valve 1201 and the suction pressure is dropped to the set point 1301. When the pressure drops to the set point 1102, the controller 1005 starts opening the hot gas bypass valve 1006, thereby injecting hot gas into the modular evaporators 100 and maintaining the suction pressure at a constant set point. The process of ice growth continues until the desired amount of ice is accumulated or the thickness of the ice on each side of the cold plates is equal of the half the distance between two adjacent plates.

One of the major advantages of the flat cold plate heat exchanger is the predictability of the process of ice growth. The outside surface of the ice slab is approximately parallel to the plate. When the water freezes it expands and squeezes out excess water between the ice slabs to the sides preventing excessive pressure build up. The method of calculating the ice thickness is disclosed in the U.S. Pat. No. 7,832,217 to Reich. Using measurements of the refrigerant in the suction line from the pressure sensor 1009 and the temperature sensor 1010, the controller 1005 calculates an integral starting from the moment when ice accumulation begins (refrigerant saturation temperature Tr drops below freezing point of water):

$$I(t)=\int Tr(T)*d\tau$$

where Tr is changing with time t. The thickness of the ice on one side of a cold plate is calculated using the following formula:

$$x=\sqrt{\frac{2*I*K*Ui/pi}{ci}}$$

where Ui is the thermal conductance of ice, ρi is the density of ice, Ci is the latent heat of ice, and K is a correction coefficient associated with the design parameters of the heat exchanger (experimentally derived). When the thickness of the ice reaches the desired value or the half distance between adjacent cold plates (whichever is greater) the process of ice growth is stopped by turning off the compressor.

In the ice harvesting mode the compressor is turned off and the water pumps are turned on. The warm water coming from the loads 1008 are fed to the nozzles 403 and 404 which generate warm water jets and thaw the ice. Cold water is supplied to the loads 1008 by pumps 1007 and 1012.

In hybrid mode the compressor 1001, as well as the water pumps 1007 and 1012, are on. The temperature of the cold plates 104 are allowed to drop below the freezing point of the water. Ice grows on the surfaces of the cold plates. Simultaneously warm water jets generated by the nozzles 403 and 404 thaw the ice. When the heat load drops, the quantity of ice increases. Conversely, when the load increases, the quantity of accumulated ice decreases. As a result the sum of the latent heat of the thawed ice and the refrigeration cycle match the cooling load. This mode allows for a reduction in the installed capacity of the whole refrigeration system. In other words, a smaller compressor and condensing unit could be utilized. It should be understood that instead of water other heat transfer liquids can be used, as an example, a solution of ethylene glycol in water.

While this invention has been described in conjunction with the various exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A modular direct expansion evaporator comprising:

a first module;

a second module;

a direct expansion cold plate comprised of two substantially flat face surfaces, two vertical edge surfaces and a horizontal top and bottom;

a first end plate; and a second end plate;

wherein the first and the second modules each comprise frames, the frames adapted to be compressed between the first end plate and the second end plate, with the direct expansion cold plate situated in between, in such a manner that a liquid tight vessel is formed;

wherein each of the frames includes liquid heat transfer medium supply ducts arranged horizontally and running perpendicular to the face plane of the direct expansion cold plate and intersecting the face plane of the frames such that each of the liquid heat transfer medium supply ducts is in fluid communication with an intersecting liquid heat transfer medium header arranged vertically, and running parallel to the vertical edge surfaces of the direct expansion cold plate inside the frame, each of the liquid heat transfer medium headers in fluid communication with nozzles directed at face surfaces of the direct expansion cold plate;

wherein each of the frames further comprises liquid heat transfer medium drain pass ways running perpendicular to the face surfaces of the direct expansion cold plate in fluid communication with drain openings on internal surfaces of the frame;

wherein each of the frames further comprises refrigerant pass ways running perpendicular to the face surfaces of the direct expansion cold plate in fluid communication with refrigerant half-headers located on opposite face sides of each of the respective frames;

wherein, when the first module and the second module are compressed together, corresponding refrigerant half-headers on adjacent face sides form either liquid refrigerant headers or suction refrigerant headers, corresponding liquid heat transfer medium supply ducts form a liquid heat transfer medium supply manifold, corresponding liquid heat transfer medium drain pass ways form a liquid heat transfer medium drain manifold, and corresponding refrigerant pass ways form either a liquid refrigerant manifold or a suction refrigerant manifold, and wherein the liquid refrigerant headers and suction refrigerant headers are in fluidic communication with the direct expansion cold plate.

2. The modular direct expansion evaporator of claim 1, wherein the frames are adapted to be mechanically compressed and retained between the first end plate and the second end plate.

3. The modular direct expansion evaporator of claim 2, wherein the frames are adapted to be mechanically compressed and retained using a set of tension rods.

4. The modular direct expansion evaporator of claim 1, wherein the distance between the vertical edges of the direct expansion cold plate and the tips of each nozzle is adequate to maintain unfrozen pockets of liquid heat transfer medium.

5. The modular direct expansion evaporator of claim 1, wherein the direct expansion evaporator is adapted to recirculate the liquid heat transfer medium through the nozzles, the nozzles adapted to generate submerged liquid heat transfer medium jets in the direction of the direct expansion cold plate.

6. The modular direct expansion evaporator of claim 1, wherein the liquid heat transfer medium is removed for recirculation through the liquid heat transfer medium drain manifold.

7. The modular direct expansion evaporator of claim 1, wherein when liquid refrigerant is injected in the liquid refrigerant manifold, the liquid refrigerant flows through the liquid refrigerant headers into the direct expansion cold plate where it is evaporated and extracts heat from the liquid heat transfer medium, and refrigerant vapor passes through the suction refrigerant header and is removed through the suction refrigerant manifold.

8. The modular direct expansion evaporator of claim 7, wherein the direct expansion cold plate is fused to the refrigerant headers which in turn are fused to refrigerant manifold sections forming cold plate assemblies which can be inserted into the modular direct expansion evaporator frames where they are compressed together forming complete suction and liquid manifolds.

9. The modular direct expansion evaporator of claim 1, wherein the refrigerant header is divided into a liquid header section and a suction header section, and when liquid refrigerant is injected into the liquid refrigerant manifold, the liquid refrigerant flows to the liquid header section where it travels down select channels of the direct expansion cold plate into a pass-through header where it then travels up the remaining channels of the direct expansion cold plate to the suction header section and evaporated refrigerant is removed through the suction refrigerant manifold.

10. The modular direct expansion evaporator of claim 1, wherein the liquid heat transfer medium comprises water.

11. The modular direct expansion evaporator of claim 1, wherein the nozzles are arranged in columns and directed at opposing face surfaces of the direct expansion cold plate and are staggered to agitate of the liquid heat transfer medium.

12. The modular direct expansion evaporator of claim 1, wherein the direct expansion cold plate is comprised of multiple multiport extrusions assembled side-by-side.

13. The modular direct expansion evaporator of claim 1, wherein the liquid refrigerant manifold is located in the bottom part of the frames and the suction manifold is located in the top part of the frames.

14. The modular direct expansion evaporator of claim 1, wherein the direct expansion cold plate is bonded to the frame of the first module.

15. The modular direct expansion evaporator of claim 1, wherein the periphery of the first module and the second module are covered with thermal insulation.

16. The modular direct expansion evaporator of claim 1, wherein the direct expansion cold plate comprises a rolled sheet with multiple channels bonded to a flat sheet.

17. The modular direct expansion evaporator of claim 1, wherein the direct expansion cold plate comprises a corrugated sheet bonded to flat sheets thereby creating channels.

18. The modular direct expansion evaporator of claim 1, wherein the first module and the second module are substantially identical.

19. A thermal energy storage system comprising:

a first modular evaporator and a second modular evaporator, each as defined by claim 1, and each further comprising a liquid line and a suction line;

a refrigerant compressor;

a refrigerant condenser;

a first refrigerant expansion device;

a second refrigerant expansion device;

a controller;

a suction line pressure sensor; and a suction line temperature sensor;

wherein the controller calculates the superheat in the suction line of the refrigerant compressor based on measurements from the suction line pressure sensor and the suction line temperature sensor, the controller activates the first refrigerant expansion device on the liquid line of the first modular evaporator and modulates the first refrigerant expansion device to keep suction pressure at a set point, and when the suction pressure drops to the set point, due to ice accumulation on the direct expansion cold plate, the controller activates the second refrigerant expansion device in the liquid line of the second modular evaporator thereby preventing the suction pressure from dropping below the set point, this process continuing until refrigerant expansion devices on all the modular evaporators are activated.

* * * * *